US008857229B2

(12) United States Patent
Cheevers et al.

(10) Patent No.: US 8,857,229 B2
(45) **Date of Patent: *Oct. 14, 2014**

(54) PADLOCK WITH KEY RETENTION OR NON-RETENTION (AND SNAP-LOCK) FACILITY

(75) Inventors: Scott D. Cheevers, New South Wales (AU); Michael G. Lloyd, New South Wales (AU); William G. Sims, New South Wales (AU)

(73) Assignee: Celestia Pty Limited, Mascot (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/326,688

(22) Filed: Dec. 15, 2011

(65) Prior Publication Data

US 2012/0103035 A1 May 3, 2012

Related U.S. Application Data

(62) Division of application No. 11/579,232, filed as application No. PCT/AU2005/000599 on Apr. 29, 2005, now Pat. No. 8,096,151.

(30) Foreign Application Priority Data

Apr. 29, 2004 (AU) ..... 2004902253
Dec. 6, 2004 (AU) ..... 2004906968

(51) Int. Cl.

| | |
|---|---|
| ***E05B 67/22*** | (2006.01) |
| ***E05B 67/24*** | (2006.01) |
| ***E05B 11/00*** | (2006.01) |
| *E05B 63/00* | (2006.01) |

(52) U.S. Cl.
CPC ..... *E05B 67/24* (2013.01); *E05B 63/0065* (2013.01); *E05B 11/00* (2013.01)
USPC ..... 70/38 A; 70/39; 70/379 R; 70/386

(58) Field of Classification Search
USPC ..... 70/24–26, 38 A, 38 B, 38 C, 38 R, 39, 70/379 R, 386
See application file for complete search history.

(56) References Cited

U.S. PATENT DOCUMENTS 206,327 A 7/1878 Hillebarnd
1,849,070 A * 3/1932 Buehner ..... 70/38 C (Continued)

FOREIGN PATENT DOCUMENTS

GB 2364348 1/2002

OTHER PUBLICATIONS

International Search Report dated Jul. 7, 2005, for corresponding application PCT/AU2005/000599.

(Continued)

*Primary Examiner* — Suzanne Barrett
(74) *Attorney, Agent, or Firm* — Alston & Bird LLP

(57) ABSTRACT

The invention provides a padlock assembly (10) which can be convertible between a "snap lock" configuration and a configuration where a key is required to lock the padlock. Padlock assembly (10) includes a cam (62) with asymmetrical driver engaging means (64). Cam (62) can be inserted in the padlock assembly (10) in either of two positions to provide dual functionality. The invention also provides the cam (62), a driver (50) and a shackle (36) for a padlock assembly.

12 Claims, 13 Drawing Sheets

(56) References Cited

U.S. PATENT DOCUMENTS

| | | | | |
|---|---|---|---|---|
| 2,460,615 | A | 2/1949 | Andrew | |
| 3,143,872 | A | 8/1964 | Check | |
| 4,158,952 | A | 6/1979 | Oliver et al. | |
| 4,528,828 | A | 7/1985 | Poutiainen | |
| 4,776,187 | A | 10/1988 | Evans et al. | |
| 4,838,051 | A * | 6/1989 | Yang | 70/38 A |
| 5,174,136 | A | 12/1992 | Thwing | |
| 5,377,511 | A | 1/1995 | Meckbach | |
| 5,592,837 | A | 1/1997 | McBride | |
| 6,766,673 | B2 | 7/2004 | Gast et al. | |
| 6,769,277 | B1 | 8/2004 | Chang | |
| 6,813,913 | B2 | 11/2004 | Watts | |
| 7,036,344 | B2 | 5/2006 | Gast et al. | |
| 7,472,568 | B2 | 1/2009 | Tang | |
| 7,856,855 | B2 | 12/2010 | Fantl et al. | |
| 2002/0007654 | A1 | 1/2002 | Watts | |
| 2002/0078720 | A1 | 6/2002 | Watts | |
| 2003/0070453 | A1 * | 4/2003 | Gast et al. | 70/38 A |
| 2010/0269550 | A1 | 10/2010 | Fantl et al. | |

OTHER PUBLICATIONS

Written Opinion of the International Searching Authority dated Jul. 7, 2005, for corresponding application PCT/AU2005/000599.

International Preliminary Report on Patentability dated Apr. 11, 2006, for corresponding application PCT/AU2005/000599.

* cited by examiner

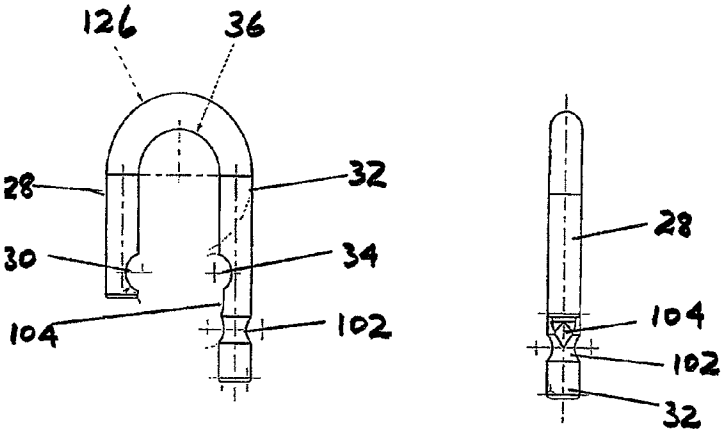
FIGURE 14
FIGURE 15
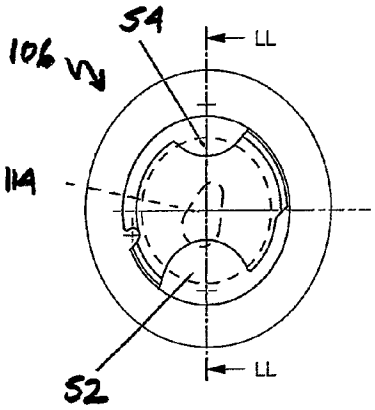
FIGURE 16
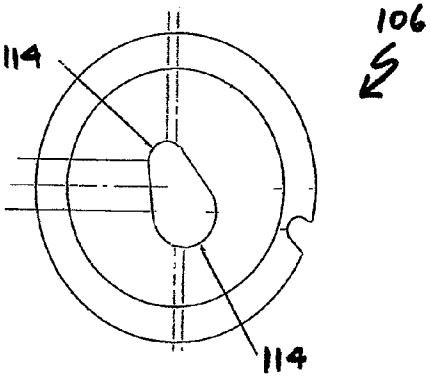
FIGURE 17
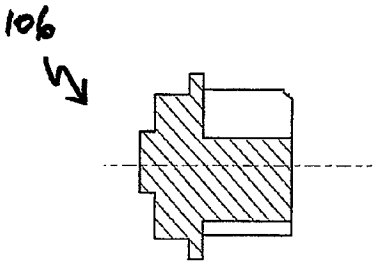
FIGURE 18

PADLOCK WITH KEY RETENTION OR NON-RETENTION (AND SNAP-LOCK) FACILITY

CROSS-REFERENCE TO RELATED APPLICATIONS

This application is a divisional of U.S. Application Ser. No. 11/579,232, filed Apr. 21, 2008, which is a U.S. National Stage under 35 U.S.C. 371 of PCT/AU2005/000599, filed Apr. 29, 2005, which claims priority to AU 2004902253, filed Apr. 29, 2004 and AU 2004906968, filed Dec. 6, 2004, all of which are incorporated herein in their entirety.

BACKGROUND OF THE INVENTION

Technical Field

This invention relates to a padlock assembly. More particularly, the invention relates to a padlock assembly with dual functionality.

It is desirable for a padlock to be convertible between two configurations. In the first configuration, when the padlock is unlocked or open, the key can be removed. In the second configuration, the key is retained in the keyway when the padlock is unlocked or open; the key cannot be removed until the padlock is returned to the locked or closed state.

It is an object of this invention, at least in one aspect, to provide a padlock assembly which is easily convertible from the first configuration to the second configuration and which does not require extra components for the conversion.

It is a further object of the present invention, at least in some embodiments, to provide a padlock assembly which allows for easy assembly and disassembly and hence easy removal of the padlock shackle from the padlock body.

These and other objects will be apparent from the description of the invention below.

SUMMARY OF THE INVENTION

In a first aspect, this invention provides a padlock assembly including a padlock body having a first shackle recess and a second shackle recess, a cylinder recess and a transverse recess communicating with the first and second shackle recesses and the cylinder recess, the cylinder recess being adapted to receive a lock assembly operable by a key; a shackle having a first leg adapted for receipt in the first shackle recess, the first leg including a first locking recess, and a second leg adapted for receipt in the second shackle recess, the second leg including a second locking recess, the second leg being spaced apart from the first leg; means for retaining the second shackle leg in the second shackle recess within the padlock body; a first shackle ball in the transverse recess adapted to fit partially into the first locking recess; a second shackle ball in the transverse recess adapted to fit partially into the second locking recess; a driver located in the transverse recess and having third and fourth locking recesses and cam engaging means; and a cam having driver engaging means; wherein the driver engaging means is asymmetrical and the cam is adapted to be inserted in the padlock assembly in either a first position, in which, when the lock assembly is unlocked by the key, the key is removable from the lock assembly, or a second position in which, when the lock assembly is opened by the key, the key cannot be removed from the lock assembly.

The invention also provides the driver and (separately) the cam defined above. In a second aspect, this invention provides a padlock assembly including a padlock body having a first shackle recess and a second shackle recess; a shackle having a first leg adapted for receipt in the first shackle recess, and a second leg adapted for receipt in the second shackle recess; and means for retaining the second shackle leg within the second shackle recess within the padlock body. The retaining means further includes a pin projecting from the padlock body into the second shackle recess; and a groove in the second leg of the shackle, the groove having a stop at each end, the groove being adapted to receive the pin.

In a third aspect, this invention provides a shackle for a padlock assembly, the assembly including a padlock body having a first shackle recess and a second shackle recess, the shackle including a first leg adapted for receipt in the first shackle recess, and a second leg adapted for receipt in the second shackle recess; wherein the second leg also includes a groove with a stop at each end, the groove being adapted to receive a pin projecting from the padlock body into the second shackle recess. Usually, the second leg of the shackle is longer than the first leg and the second shackle recess in the padlock body is accordingly longer than the first shackle recess.

The padlock assembly of the invention in either the first or second aspect may take any conventional exterior form. The shackle may also take various forms, with the shackle or hasp having the first and second legs joined by a bridge of any suitable shape. Conventionally, the first and second legs and the bridge form a "U" shape, but the shackle in this invention is not limited to that shape.

The lock assembly operable by a key to be inserted in the cylinder recess may be any suitable type of lock assembly, including a pin tumbler lock assembly and a disc tumbler lock assembly.

In the first aspect of the invention, the means for retaining the second shackle leg in the second shackle recess within the padlock body can take any appropriate form. Reference is made, for example, to U.S. Pat. No. 5,174,136 (Thwing), the contents of which are imported herein by reference. The retaining means may also take the form of the retaining means referred to in connection with the second aspect of the present invention. In this second aspect, the retaining means includes a pin which projects from the padlock body into the second shackle recess. There is a groove in the second leg of the shackle, the groove being adapted to receive the pin. The groove has a stop at each end to limit the amount of travel of the pin within the groove, allowing the shackle to partly extend to the unlocked position. Preferably, the pin is removable, being held captive against a longitudinal face of the lock assembly. If the lock assembly is removed, the pin can be extracted, enabling easy removal of the shackle without the need to disassemble the lock assembly.

The first and second shackle balls in the transverse recess are known in the prior art—see, for example, U.S. Pat. No. 5,174,136. The driver located in the transverse recess is adapted to be coupled to the lock assembly as explained in further detail below. When the padlock assembly of the invention is locked, the driver holds the first and second shackle balls in engagement with the first and second locking recesses of the shackle, preventing movement of the shackle. The driver may be rotated towards an unlocked position in which the first and second shackle balls can move into the third and fourth locking recesses respectively so that the first and second shackle balls are no longer received in the first and second locking recesses so as to interfere with movement of the shackle.

The shackle can therefore extend to the extent permitted by the means which retain the second shackle leg in the second shackle recess, such as the pin and groove arrangement of the second aspect of the present invention.

The driver in the padlock assembly of the invention may be in one or more parts. In one particularly preferred embodiment, the driver is in two parts, an upper part and a lower part.

In this embodiment, the upper and lower parts are permanently joined during manufacture. Manufacture of the driver in two parts can reduce costs. Further advantages are mentioned below.

The driver in the padlock assembly of the invention includes cam engaging means. The cam engaging means may be of any suitable configuration. Preferably the cam engaging means consists of two asymmetric prongs or protrusions. A preferred configuration of the driver prongs is shown in the accompanying drawings discussed further below.

The cam of the padlock assembly of the invention has driver engaging means. This may take any suitable configuration but preferably includes two slots and a keyway. A preferred embodiment is illustrated in the drawings, below. The driver engaging means of the cam is asymmetrical and designed to be inserted in the padlock assembly in one of two positions. In the first position, when the lock assembly is unlocked by the key, the key is removable from the lock assembly. In the second position, when the lock assembly is opened by the key, the key is retained in the lock assembly and cannot be removed until the lock assembly is locked. In the first position in the preferred embodiment, the driver engaging means of the cam can engage and rotate the driver so that the first and second shackle balls can move into the third and fourth locking recesses of the driver. The cam and lock assembly are not restricted from returning to the position where the key can be removed from the lock assembly, even when the shackle is in the unlocked position. In the second position in the preferred embodiment, one of the prongs of the cam engaging means is adapted to locate in the keyway of the cam. When the cam engages the driver and rotates so that the first and second shackle balls move into the third and fourth locking recesses, the keyway on the cam prevents the cam and lock assembly from returning to the position where the key can be removed. Thus the key is retained in the lock assembly until the shackle is closed and the driver is rotated to the original position, at which stage the key can be removed. Thus the key cannot be removed from the lock assembly while the padlock is open.

To convert the padlock assembly of the invention from the first position in which the key can be removed, to the second position in which the key cannot be removed when the padlock is open, in the preferred embodiment the cam is designed to be inserted in the assembly in one of two orientations. In the second orientation, the cam is inserted in the assembly in a configuration which is rotated by 180° from the first configuration. Preferably, the cam is screwed to the lock assembly by screws (preferably two). It is a simple matter to remove these screws, rotate the cam 180°, replace it on the cylinder and replace the screws, in order to convert the padlock assembly of the invention from the first position (key removable) to the second position (key not removable).

It is to be appreciated that, in the first position, in order to relock the padlock assembly, the shackle in the open position may be pressed back into the padlock body. This is commonly called a "snap-shut" function.

It is particularly preferred that the padlock assembly of the invention in either the first or second aspect includes a key stop plate and a spring, adapted to fasten together with the driver to form one pre-tensioned unit. This facilitates padlock assembly and disassembly. In one embodiment, it is preferred that the key stop plate has two internal tags designed to enter a bridging slot to seat into a radial groove formed in the driver. In this embodiment, once tensioned with the spring, the key stop plate cannot disengage from the driver. The radial groove is preferably of a suitable length to prevent the driver from over-rotating when the key and lock assembly are rotated.

In the same embodiment, it is further preferred that the key stop plate includes a bent tang designed to engage with a slot on the cam.

In a second embodiment, the key stop plate has one internal tag designed to enter a receiving groove in the driver. In this second embodiment, the bent tang of the first embodiment is replaced by a solid protruding stop.

The key stop plate in both embodiments performs the same function. The purpose of this is to prevent the lock assembly from returning past the key removal position in which, in the case of a pin tumbler lock assembly, the lower pins in the lock assembly cylinder are aligned with the bores in the lock assembly cylinder housing, permitting the key to be removed.

It is further preferred that the key stop plate is not designed to rotate with the driver, being restrained by the padlock body.

If the driver is manufactured in two parts and fastened together in a sub-assembly with the key stop plate and spring, this can ensure that the key stop plate and spring are held captive. The sub-assembly can represent a single pre-tensioned unit which can be easily assembled into the padlock. This design can be advantageous, because it can prevent the key stop plate and spring from being forced off the driver and falling apart, as occurs with many prior art padlocks.

DESCRIPTION OF THE DRAWINGS

The invention will now be described in connection with certain non-limiting embodiments in the accompanying drawings, in which:

FIG. 14 is a side elevation of the shackle shown in FIG. 13;

FIG. 15 is an end elevation of the shackle of FIG. 14;

FIG. 16 shows in plan view from below the upper part of the two-part driver;

FIG. 17 shows in plan view from above the upper driver part of FIGS. 16;

FIG. 18 is a sectional view of the upper driver part, taken along the line LL-LL of FIG. 17;

FIG. 31 is a perspective view of a further embodiment of the lower part of the two part driver of which FIG. 27 shows the upper part;

DETAILED DISCUSSION OF VARIOUS EMBODIMENTS

It is to be appreciated that the views in the various Figures are not drawn to the same scale.

Figure 1:
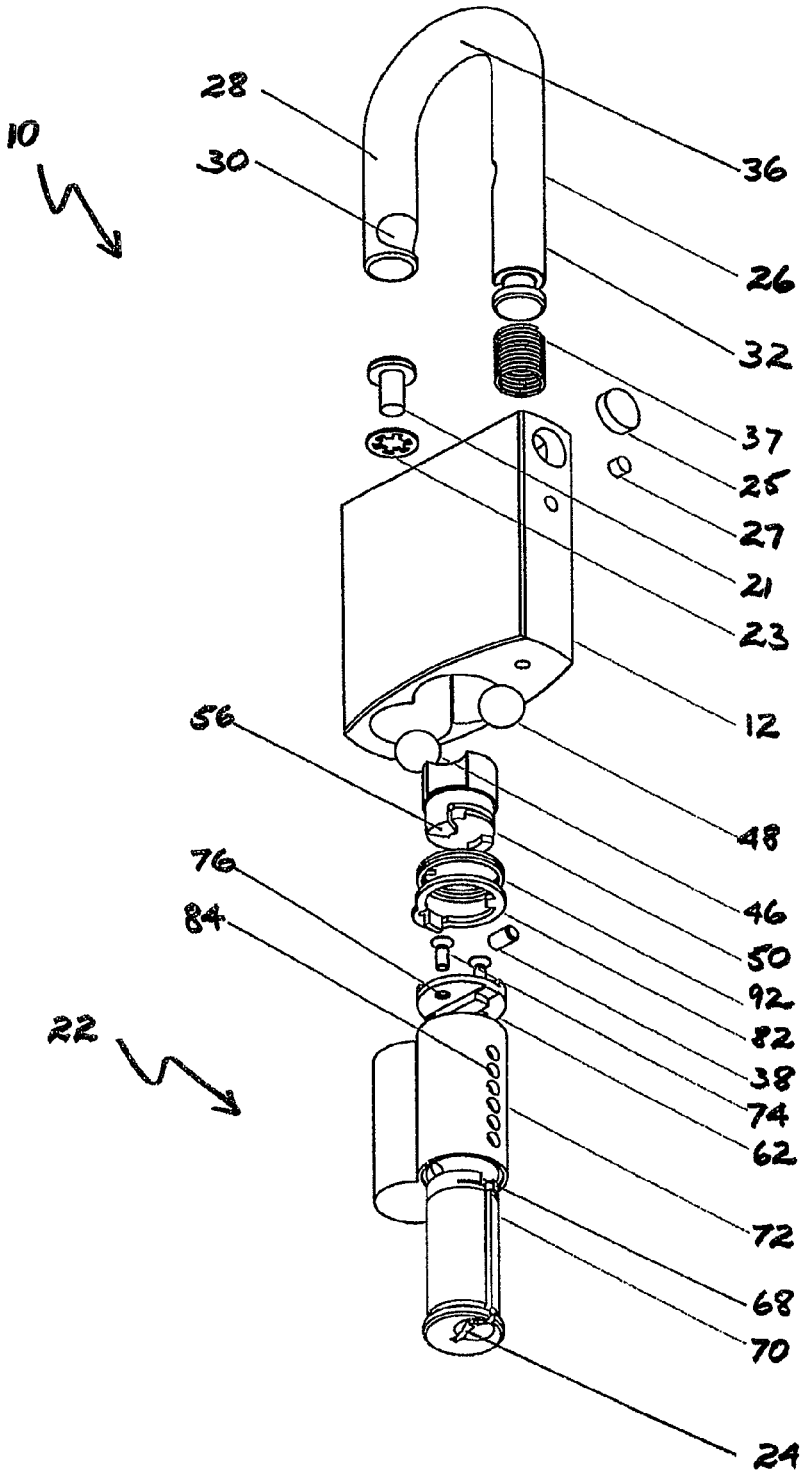
FIG. 1 is an exploded, perspective view of a first preferred embodiment of the padlock assembly of the invention in the first and second aspects.
Figure 2:
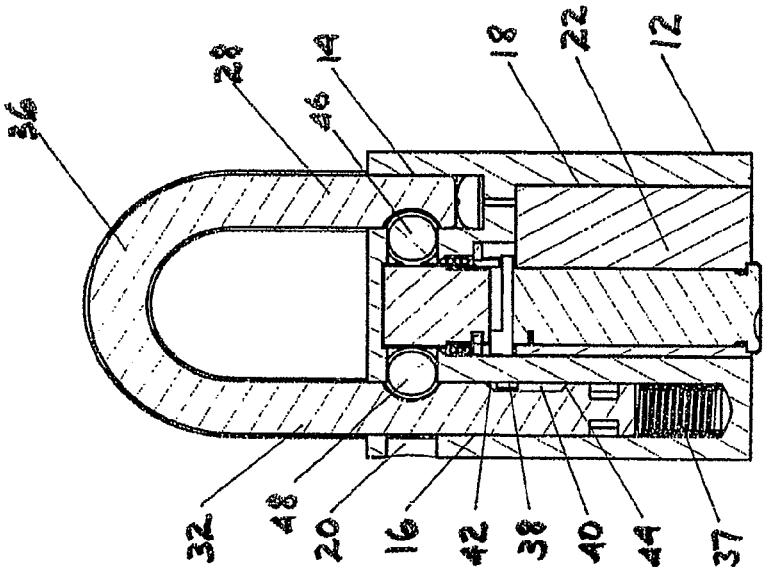
FIG. 2 is a cross-sectional view of the padlock assembly of FIG. 1, assembled.

Turning first to FIGS. 1 and 2, padlock assembly 10 has padlock body 12 in which there is first shackle recess 14 and second shackle recess 16 (refer FIG. 2). Padlock body 12 also includes cylinder recess 18 and transverse recess 20 which communicates with first shackle recess 14, second shackle recess 16 and cylinder recess 18. Cylinder recess 18 is shaped to receive lock assembly 22, which in this embodiment is a standard pin tumbler lock assembly, operated by a key (not shown) to be inserted in keyway 24.

Figure 4:
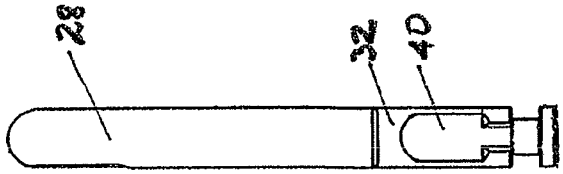
FIG. 4 is an end elevation of the shackle of FIG. 3.
Figure 3:
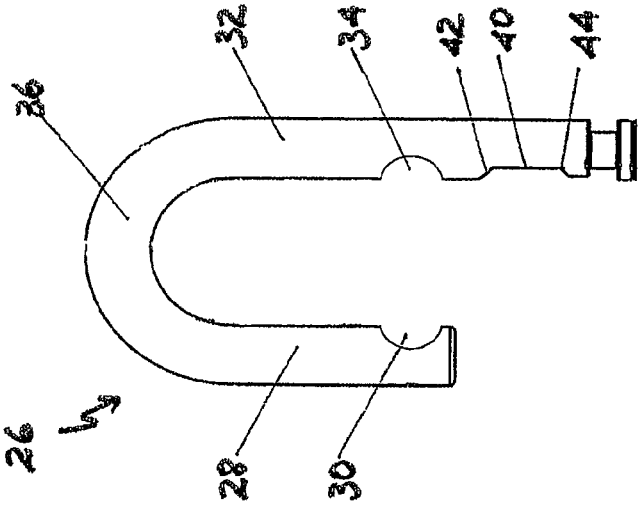
FIG. 3 is a side elevation of the shackle shown in FIGS. 1 and 2 and represents a preferred embodiment of the shackle of the third aspect of the invention.

As may be seen in FIGS. 1 and 2 and also in FIGS. 3 and 4, shackle 26 has first leg 28 in which is cut first locking recess 30 and second, longer leg 32 in which is cut second locking recess 34. First leg 28 and second leg 32 are joined by bridge 36 to form a generally U-shaped shackle. Shackle 26 is biased towards the open position by shackle spring 37.

Shackle 26 is retained in padlock body 12 by means of pin 38 (FIG. 2) which projects from padlock body 12 into second shackle recess 16. Pin 38 is received in groove 40 formed in second leg 32. Groove 40 has at one end stop 42 and at the other stop 44, effectively limiting the distance of travel of second leg 32 within second shackle recess 16. Removal of lock assembly 22 enables removal of pin 38 which in turn releases second shackle leg 32 from second shackle recess 16 (when padlock assembly 10 is in the unlocked position). This enables a simple method of removing shackle 26 from padlock body 12.

As best illustrated in FIG. 2, first shackle ball 46 is located in transverse recess 20 and is designed to fit partially into first locking recess 30 in first shackle leg 28. Second shackle ball 48 is located in transverse recess 20 and is designed to fit partially into second locking recess 34 in second shackle leg 32. The locked configuration is shown in FIG. 2.

Lock assembly 22 is secured to padlock housing 12 by screw 21 and toothed washer 23. Assembly plugs 25 and 27 are received in apertures in padlock body 12 as shown.

Figure 5:
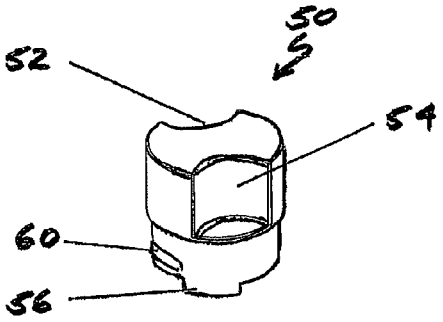
FIG. 5 is a perspective view of a driver, being part of the padlock assembly of FIG. 1.
Figure 6:
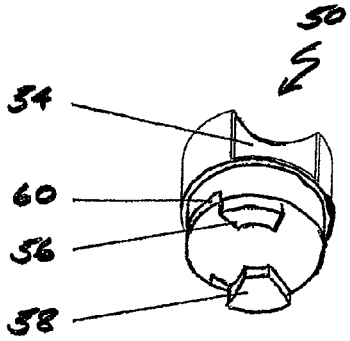
FIG. 6 is a perspective view from below of the driver of FIG. 5.

Driver 50, which is shown in more detail in FIGS. 5 and 6, is also located in transverse recess 20. Driver 50 includes third and fourth locking recesses 52 and 54 and cam engaging means in the form of asymmetric prongs 56 and 58.

Driver 50 includes radial groove 60, being of a suitable length to prevent driver 50 from over-rotating when lock assembly 22 is rotated after insertion of the key (not shown).

Figure 7:
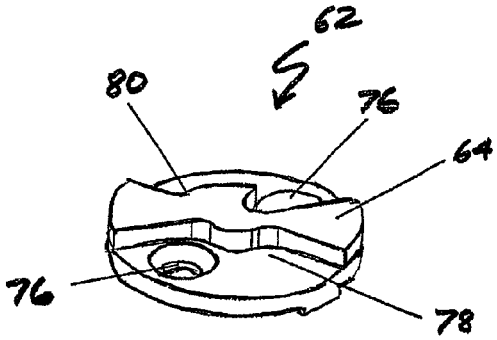
FIG. 7 is a perspective view of the cam included in the padlock assembly of FIG. 1.
Figure 8:
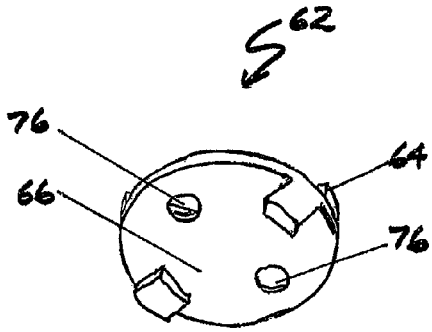
FIG. 8 is a perspective view from below of the cam of FIG. 7.

Padlock assembly 10 includes cam 62, shown in more detail in FIGS. 7 and 8. Cam 62 has on its upper surface driver engaging means 64 and on its lower surface lock assembly engaging means in the form of protrusion 66. Protrusion 66 is designed to be received within a complementary recess 68 on cylinder 70 of lock assembly 22, lock assembly 22 including cylinder housing 72. Cain 60 is secured to cylinder 70 by cam screws 74 inserted through holes 76.

When cam 60 is secured to cylinder 70 in the first position, larger prong 56 on driver 50 locates in slot 78 of cam 62. When cylinder 70 is rotated by the key (not shown), cam 62 engages driver 50 to release the first shackle ball 46 and the second shackle ball 48 into the third locking recess 52 and the fourth locking recess 54, respectively. Cam 62 and cylinder 70 are free to return to the original position in which the key (not shown) can be removed from cylinder 70 without closing shackle 26.

If cam 62 is unscrewed from cylinder 70 and reattached after having been rotated by 180°, larger prong 56 of driver 50 will engage in keyway 80 of cam 62. When a key is inserted to keyway 24 of cylinder 70 and rotated to release first shackle ball 46 and second shackle ball 48 into third locking recess 52 and fourth locking recess 54 respectively, keyway 80 on cam 62 prevents return of cam 62 and cylinder 70 to the original position where the key (not shown) can be removed. Hence, the key (not shown) is held captive within cylinder 70 until shackle 26 is closed.

It will be appreciated by one skilled in the art that the ability to insert cam 62 in padlock assembly 10 in either of the two positions described by simple removal of the cam screws and relocation of cam 62 provides significant advantages in converting padlock assembly 10 from a configuration where the key can be removed when the padlock is unlocked, to the configuration where the key cannot be removed when the padlock is unlocked. This arrangement has the advantage of minimizing parts inventory, and of providing a robust padlock assembly.

Figure 9:
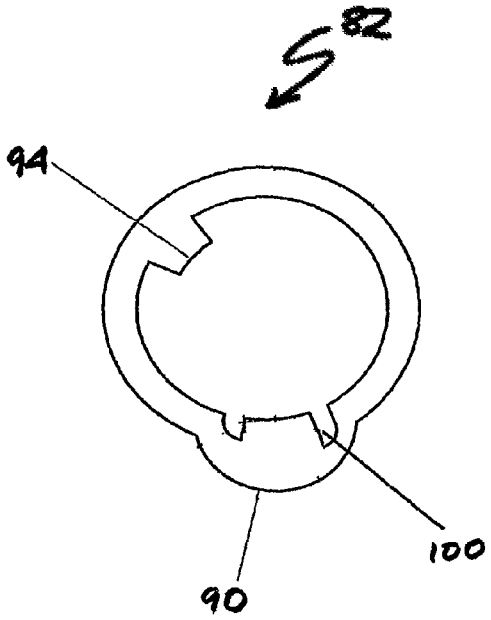
FIG. 9 is a plan view of a key stop plate, being part of the padlock assembly of FIG. 1.
Figure 10:
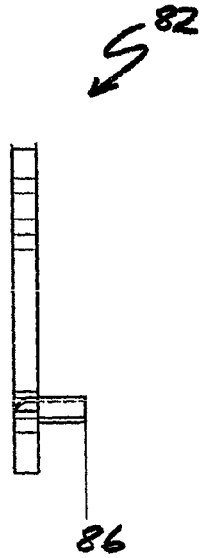
FIG. 10 is a side elevation of the key stop plate of FIG. 9.

Reference is now made to the key stop plate in FIGS. 9 and 10. Key stop plate 82 is included in padlock assembly 10 for the purpose of ensuring that, when a key is inserted in cylinder 70 and cylinder 70 is rotated, using the key, to the original, locked position, it is not possible to rotate cylinder 70 beyond the original position in which the key can be removed. In order for the key to be removed, in the case of a pin tumbler assembly, the lower pins in cylinder 70 must be aligned with bores 84 in cylinder housing 72. Key stop plate 82 ensures that proper alignment takes place. Key stop plate 82 has bent tang 86 to engage with cam slot 78 or cam slot 88 (depending on the orientation of cam 62) for this purpose. Key stop plate 82 includes tongue 90 which engages padlock body 12 so that key stop plate 82 does not rotate with cam 62 and driver 50.

Figure 11:
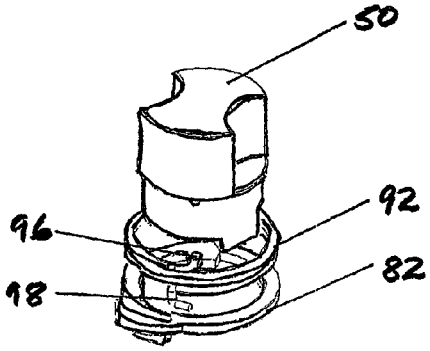
FIG. 11 shows the driver of FIGS. 5 and 6, the key stop plate of FIGS. 9 and 10 and the spring included in the padlock assembly of FIG. 1, prior to assembly into one pre-tensioned unit.
Figure 12:
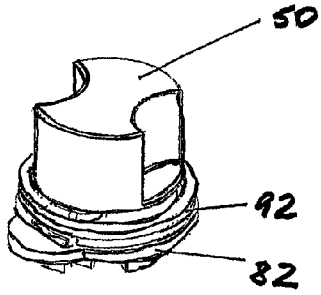
FIG. 12 shows the components of FIG. 11 after assembly.
Figure 13:
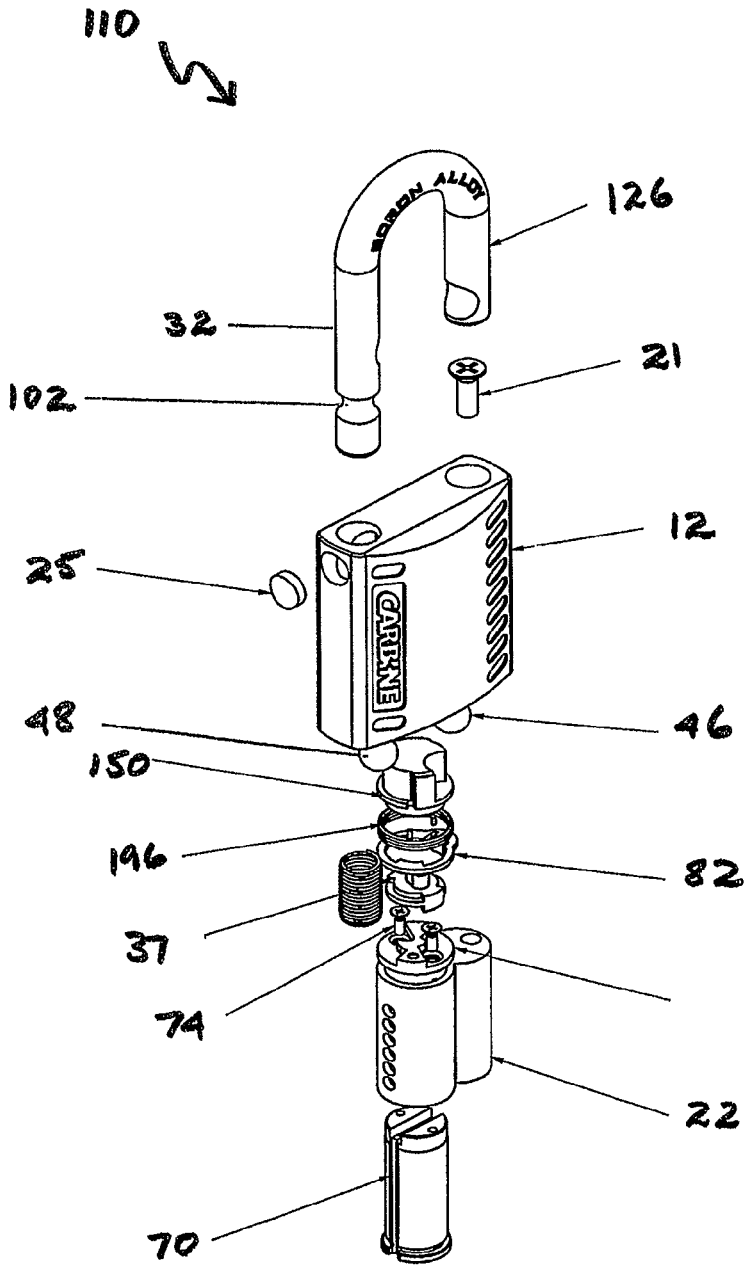
FIG. 13 is an exploded, perspective view of a second embodiment of the padlock assembly of the invention in the first aspect, showing a two-part driver.
Figure 19:
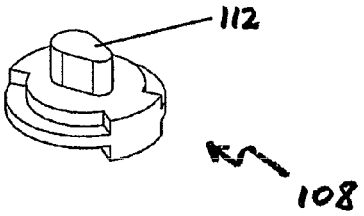
FIG. 19 is a perspective view of the lower part of the two-part driver.
Figure 20:
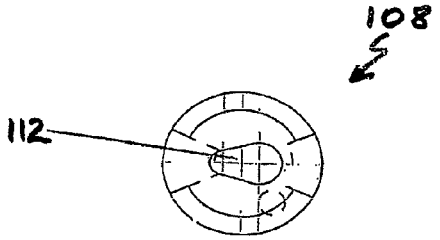
FIG. 20 is a top plan view of the lower driver part of FIG. 19.
Figure 21:
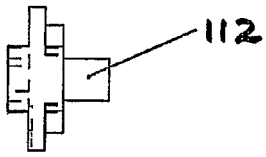
FIG. 21 is a side elevation of the lower driver part of FIG. 20.

FIGS. 11 and 12 show driver 50, key stop plate 82 and driver spring 92 forming a single pre-tensioned unit to enable easy padlock assembly and disassembly. Key stop plate 82 includes internal tag 94. Tag 94 is designed to engage in radial groove 60 on driver 50. Driver spring 92 provides the desired tension between key stop plates 82 and driver 50, with one end 96 of spring 92 engaging driver 50 and the other end 98 of spring 92 engaging slot 100 of key stop plate 82. Once tensioned with spring 92, key stop plate 82 cannot disengage from driver 50. Radial groove 60 is of a suitable length to ensure that driver 50 does not over rotate when cylinder 70 is turned by the key (not shown).

In relation to shackle 26, it will be observed from FIGS. 3 and 4 that second locking recess 34 on second shackle leg 32 is separate from shackle retaining groove 40. It will be appreciated by one skilled in the art that this enables shackle 26 to be stronger than prior art shackles in which the second locking recess is in communication with a shackle retaining recess.

Referring now to the second embodiment in FIGS. 13 to 20, padlock assembly 110 operates in much the same way as padlock assembly 10 in the first embodiment, and like numbers will be used to denote like parts.

Instead of shackle 26 being retained in padlock body 12 by means of pin 38 as shown in FIG. 2, shackle 126 is retained conventionally by shackle ball 48, having a peripheral recess 102 towards the end of second leg 32. Second leg 32 includes channel 104 which provides communication between second locking recess 34 and peripheral recess 102 (refer FIGS. 14 and 15).

Figure 22:
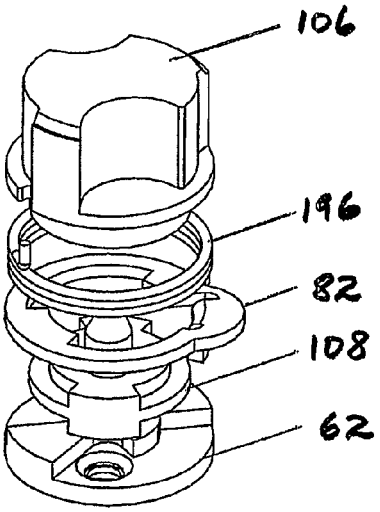
FIG. 22 is an exploded, perspective view of a sub-assembly of the second embodiment.
Figure 23:
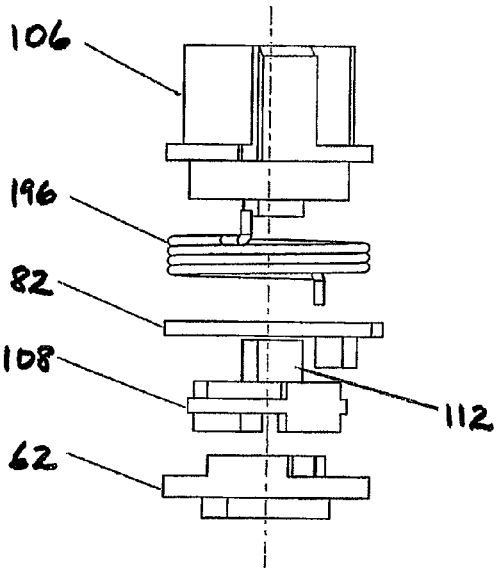
FIG. 23 is a side elevation of the exploded, sub-assembly of FIG. 22.
Figure 24:
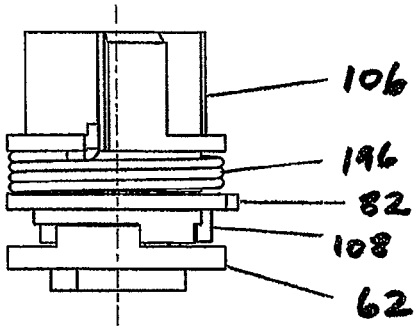
FIG. 24 shows the sub-assembly in side elevation, assembled.
Figure 25:
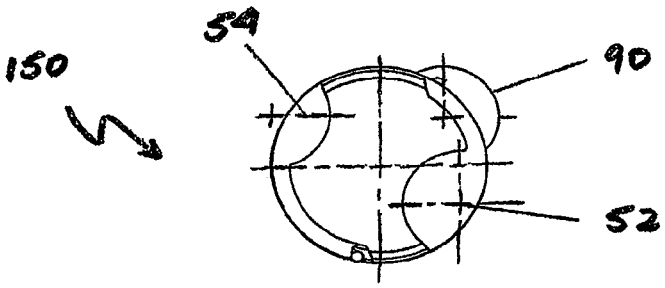
FIG. 25 is a top plan view of the sub-assembly of FIGS. 22 to 24.
Figure 26:
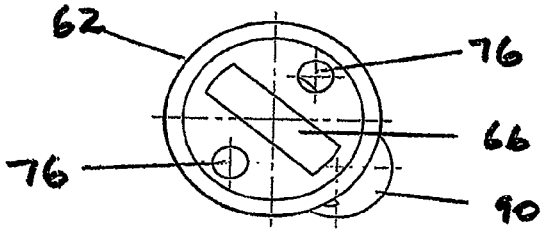
FIG. 26 is a bottom plan view of the sub-assembly.
Figure 29:
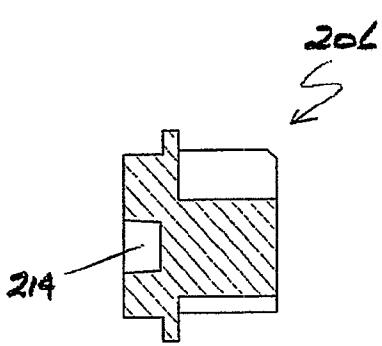
FIG. 29 is a sectional view of the upper driver part of FIG. 27, taken along the line L-L of FIG. 28.
Figure 28:
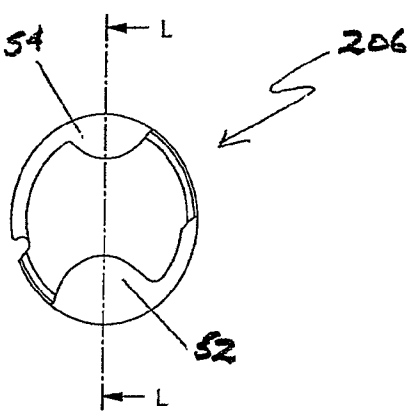
FIG. 28 shows in plan view from above the upper driver part of FIG. 27.
Figure 27:
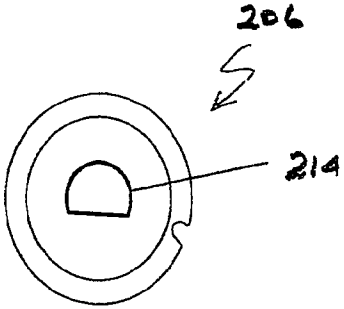
FIG. 27 shows in plan view from below the upper part of a different embodiment of the two-part driver.
Figure 32:
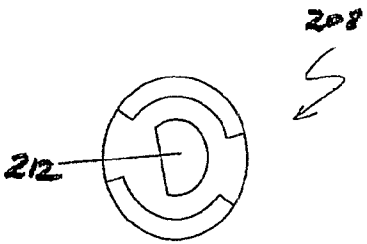
FIG. 32 is a top plan view of the lower driver part of FIG. 31.
Figure 31:
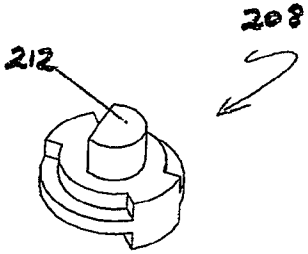
Figure 30:
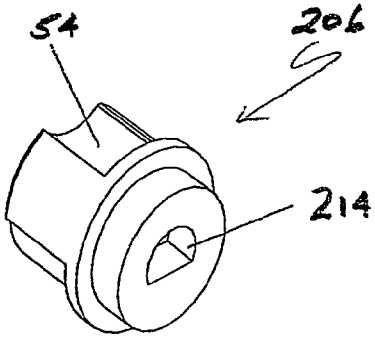
FIG. 30 is a perspective view of the upper driver part of FIG. 27.
Figure 33:
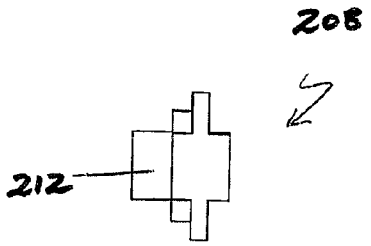
FIG. 33 is a side elevation of the lower driver part of FIG. 31.
Figure 34:
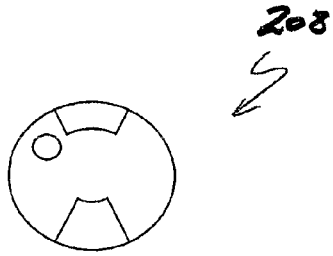
FIG. 34 is a bottom plan view of the lower driver part of FIG. 31.

Driver 150, instead of being in a single part, as in the first embodiment, has upper driver part 106 and lower driver part 108 (refer especially FIGS. 22 and 23). Lower driver part 108 has an ovoid protrusion 112 which fits into complementary cavity 114 on the underneath of upper driver part 106. As can be seen from FIGS. 22 to 24, upper driver part 106 and lower driver part 108 fit together, with an interference fit, with spring 196 and key stop plate 82 between them, to form a single, pretensioned unit. Cam 62 engages lower driver part 108 in the same manner as in the first embodiment.

Apart from the differences referred to above, the second embodiment operates in the same way as the first embodiment with regard to reversal of cam 62.

Referring now to FIGS. 27 to 30, illustrated is upper driver part 206 which in this case has "D" shaped cavity 214 on its lower side, the remaining features being substantially the same as driver 106 and being given the same numerals.

Lower driver part 208 is shown in FIGS. 31 to 34. It has a "D" shaped protrusion 212 designed to fit into cavity 214. Otherwise, lower driver part 208 resembles lower driver part 108.

Figure 35:
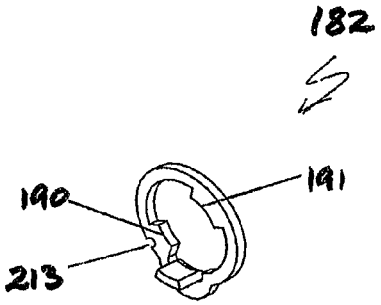
FIG. 35 is a perspective view of key stop plate which can form part of a sub assembly with the upper driver part of FIG. 27 and the lower driver part of FIG. 31.
Figure 36:
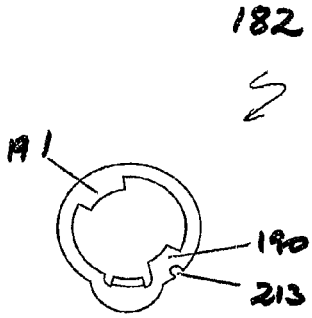
FIG. 36 is a top plan view of the key stop plate of FIG. 35.

Key stop plate 182 shown in FIGS. 35 and 36 is similar to that in FIG. 9, except that it includes notch 213 for spring 196. Key stop plate 182 also has two tongues 190 and 191 to limit key rotation.

Figure 37:
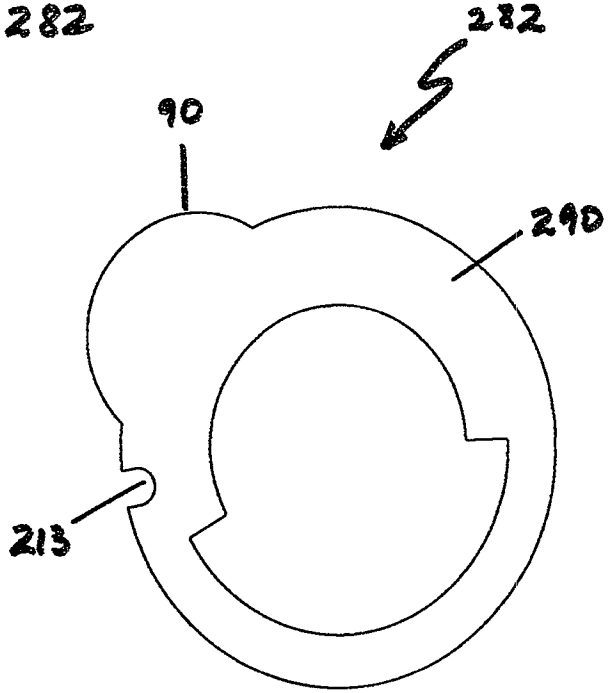
FIG. 37 is a plan view of a second embodiment of a key stop plate.
Figure 38:
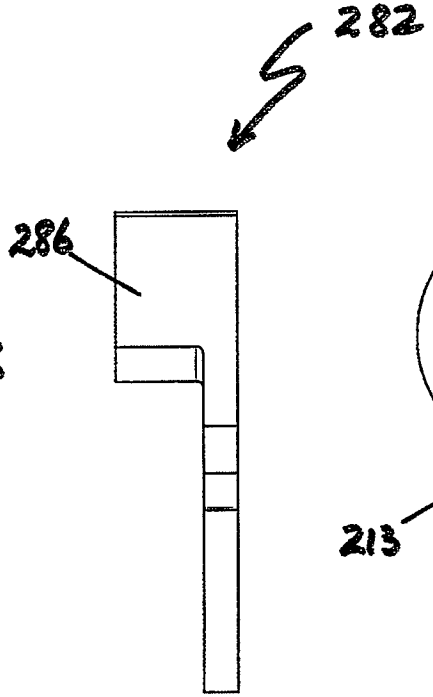
FIG. 38 is a side elevation of the key stop plate of FIG. 37.
Figure 39:
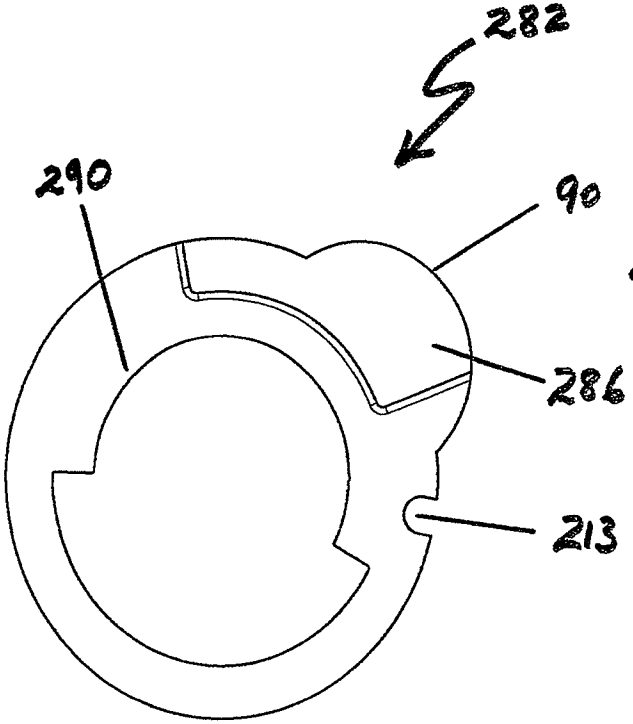
FIG. 39 is a reverse plan view of the key stop plate of FIGS. 37 and 38.
Figure 43:
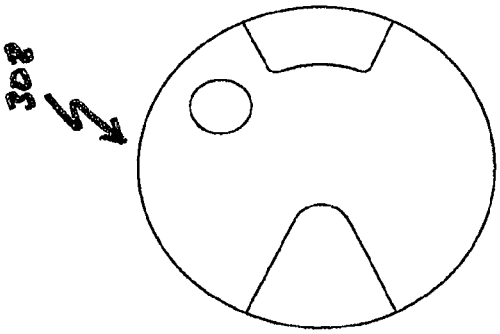
FIG. 43 is a reverse plan view of the lower driver part of FIGS. 40 to 42.
Figure 42:
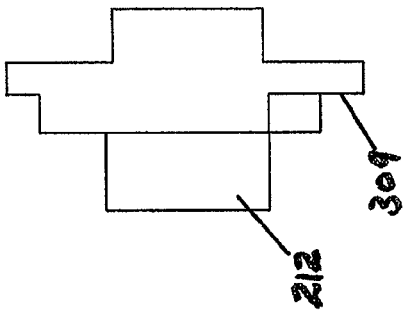
FIG. 42 is a side elevation of the lower driver part of FIGS. 40 and 41.
Figure 40:
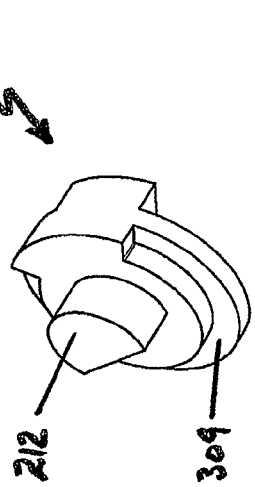
FIG. 40 is a perspective view of the lower part of a further embodiment of a two-part driver, designed to accommodate the key stop plate of FIGS. 37 to 39.
Figure 41:
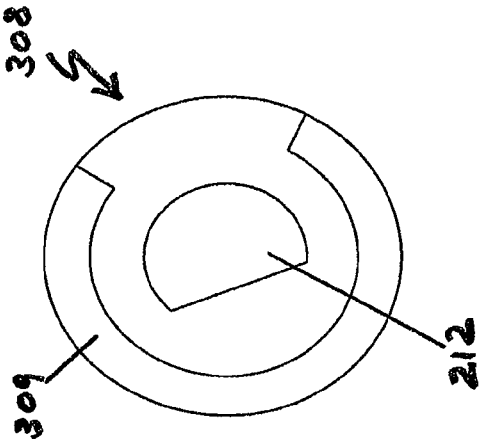
FIG. 41 is a top plan view of the lower driver part of FIGS. 40.
Figure 44:
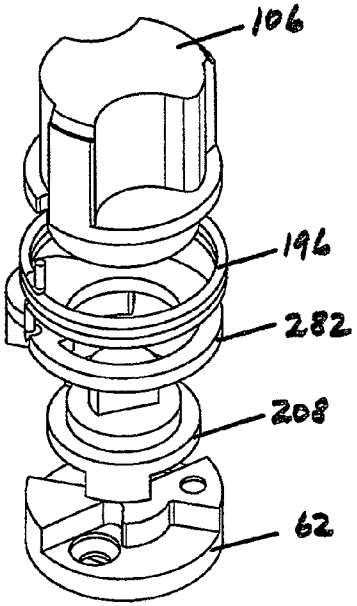
FIG. 44 is an exploded, perspective view of a sub-assembly, similar to that in FIG. 22, but including the key stop plate of FIGS. 37 to 39 and the lower driver part of FIGS. 40 to 43.
Figure 45:
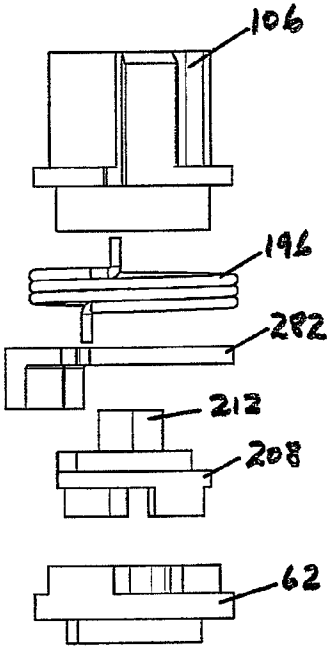
FIG. 45 is a side elevation of the exploded, sub-assembly of FIG. 44.
Figure 47:
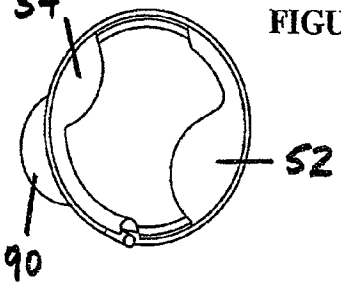
FIG. 47 is a top plan view of the sub-assembly of FIGS. 44 to 46.
Figure 46:
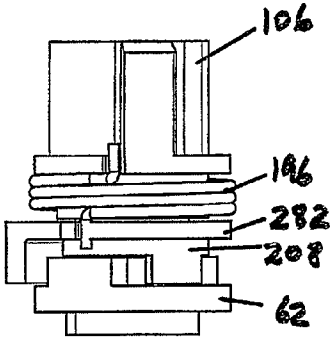
FIG. 46 shows the sub-assembly in side elevation, assembled.
Figure 48:
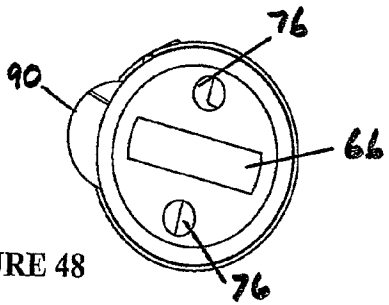
FIG. 48 is a bottom plan view of the sub-assembly.

Referring now to FIGS. 37 to 39, key stop plate 282 is similar to that in FIG. 9 and in FIGS. 35 and 36. Like key stop plate 182, key stop plate 282 includes notch 213 for spring 196. However, whereas key stop plate 182 had two tongues 190 and 191 to limit key rotation, key stop plate 282 has a single tag 290. Tongue 90 is for the purpose of engaging a padlock body (not shown), so that key stop plate 282 does not rotate with the cam and driver.

As can be seen in FIGS. 38 and 39, key stop plate 282 includes solid protruding stop 286 which operates in the same manner as bent tang 86 in relation to key stop plate 82.

Referring now to FIGS. 40 to 43, illustrated is lower driver part 308. Like lower driver part 208, it has a "D" shaped protrusion 212 designed to fit into a cavity (not shown) on the upper driver part. Lower driver part 308 has a single key stop tag receiving groove 309.

With reference to FIGS. 44 to 48, lower driver part 208 has protrusion 212 which fits into a complimentary cavity (not shown) on the underneath of upper driver part 106. Upper driver part 106 and lower driver part 208 fit together, with an interference fit, with spring 196 and key stop plate 282 between them, to form a single, pre-tensioned unit. Cam 62 engages lower driver part 208 in the same manner as described in relation to the other embodiments.

Apart from the differences referred to above, this embodiment operates in the same way as the first embodiment with regard to reversal of cam 62.

The embodiments described in the drawings are for the purposes of illustration only and are not intended to be limiting on the scope of the invention. It will be appreciated by one skilled in the art that modifications may be made without departing from the spirit and scope of the invention.

The invention in its various aspects provides a padlock assembly and a shackle, readily useful for the lock industry. In particular, the padlock assembly of the first aspect provides an elegant solution for a versatile padlock assembly, which can be converted from a "snaplock" configuration to a configuration requiring a key for locking, without the necessity to include extra components in inventory.

That which is claimed:

1. A driver for use in a padlock assembly which includes:

a padlock body having a first shackle recess and a second shackle recess;

a cylinder recess adapted to receive a lock assembly operable by a key;

a transverse recess communicating with the first and second shackle recesses and the cylinder recess;

a shackle having a first leg adapted for receipt in the first shackle recess, the first leg including a first locking recess, and a second leg adapted for receipt in the second shackle recess, the second leg including a second locking recess, the second leg being spaced apart from the first leg;

means for retaining the second shackle leg in the second shackle recess within the padlock body;

a first shackle ball in the transverse recess adapted to fit partially into the first locking recess;

a second shackle ball in the transverse recess adapted to fit partially into the second locking recess; and a cam having an asymmetrical driver engaging means and being adapted to be inserted in the padlock assembly in either a first position, in which, when the lock assembly is unlocked by the key, the key is removable from the lock assembly, or a second position in which, when the lock assembly is opened by the key, the key cannot be removed from the lock assembly;

wherein the driver is located in the transverse recess and has third and fourth locking recesses and cam engaging means, the cam engaging means comprising two asymmetric protrusions.

2. The driver of claim 1, wherein the driver engaging means includes two slots and a keyway.

3. The driver of claim 1, wherein when the cam is inserted into the second position, one of the protrusions of the cam engaging means is adapted to locate in the keyway.

4. The driver of claim 1, wherein the second position of the cam is rotated by 180 degrees from the first position.

5. A cam for use in a padlock assembly which includes:

a padlock body having a first shackle recess and a second shackle recess;

a cylinder recess adapted to receive a lock assembly operable by a key;

a transverse recess communicating with the first and second shackle recesses and the cylinder recess;

a shackle having a first leg adapted for receipt in the first shackle recess, the first leg including a first locking recess, and a second leg adapted for receipt in the second shackle recess, the second leg including a second locking recess, the second leg being spaced apart from the first leg;

means for retaining the second shackle leg in the second shackle recess within the padlock body;

a first shackle ball in the transverse recess adapted to fit partially into the first locking recess;

a second shackle ball in the transverse recess adapted to fit partially into the second locking recess; and a driver located in the transverse recess and having third and fourth locking recesses and cam engaging means;

wherein the cam has an asymmetrical driver engaging means and is adapted to be inserted in the padlock assembly in either a first position, in which, when the lock assembly is unlocked by the key, the key is removable from the lock assembly, or a second position in which, when the lock assembly is opened by the key, the key cannot be removed from the lock assembly.

6. The driver of claim 5, wherein the cam engaging means includes two asymmetric protrusions.

7. The driver of claim 5, wherein the driver engaging means includes two slots and a keyway.

8. The driver of claim 5, wherein when the cam is inserted into the second position, one of the protrusions of the cam engaging means is adapted to locate in the keyway.

9. The driver of claim 5, wherein the second position of the cam is rotated by 180 degrees from the first position.

10. A padlock assembly comprising:

a padlock body having a first shackle recess and a second shackle recess;

a shackle having a first leg adapted for receipt in the first shackle recess and a second leg adapted for receipt in the second shackle recess;

a cylinder recess and a transverse recess communicating with the first and second shackle recesses and the cylinder recess, the cylinder recess being adapted to receive a lock assembly operable by a key; and a cam having an asymmetrical driver engaging means, the cam being adapted to be inserted in the padlock assembly in either the first position, in which, when the lock assembly is unlocked by the key, the key is removable from the lock assembly, or a second position in which, when the lock assembly is opened by the key, the key cannot be removed from the lock assembly; and means for retaining the second shackle leg within the second shackle recess within the padlock body, wherein the retaining means comprises a pin projecting from the padlock body into the second shackle recess, and a groove in the second leg of the shackle, the groove having a stop at each end, the groove being adapted to receive the pin such that an end of the pin engages the groove.

11. The padlock assembly of claim 10, wherein the padlock assembly further comprises:

a cylinder recess and a transverse recess communicating with the first and second shackle recesses and the cylinder recess; and a driver located in the transverse recess and having third and fourth locking recesses and cam engaging means.

12. A shackle for use in a padlock assembly, the assembly including a padlock body having a first shackle recess and a second shackle recess, the shackle including:

a first leg adapted for receipt in the first shackle recess; and a second leg adapted for receipt in the second shackle recess, wherein:

the second leg also includes a groove with a stop at each end, the groove being adapted to receive a pin projecting from the padlock body into the second shackle recess such that an end of the pin engages the groove; and the padlock assembly including:

a padlock body having a first shackle recess and a second shackle recess, a cylinder recess and a transverse recess communicating with the first and second shackle recesses and the cylinder recess, the cylinder recess being adapted to receive a lock assembly operable by a key;

a shackle having a first leg adapted for receipt in the first shackle recess, the first leg including a first locking recess, and a second leg adapted for receipt in the second shackle recess, the second leg including a second locking recess, the second leg being spaced apart from the first leg; means for retaining the second shackle leg in the second shackle recess within the padlock body;

a first shackle ball in the transverse recess adapted to fit partially into the first locking recess; a second shackle ball in the transverse recess adapted to fit partially into the second locking recess; a driver located in the transverse recess and having third and fourth locking recesses and cam engaging means; and a cam having driver engaging means; wherein the driver engaging means is asymmetrical and the cam is adapted to be inserted in the padlock assembly in either a first position, in which, when the lock assembly is unlocked by the key, the key is removable from the lock assembly, or a second position in which, when the lock assembly is opened by the key, the key cannot be removed from the lock assembly.

* * * * *